US009062496B2

(12) United States Patent
Dancer

(10) Patent No.: US 9,062,496 B2
(45) Date of Patent: Jun. 23, 2015

(54) SYSTEMS AND METHODS FOR ROTATIONALLY ORIENTING A WHIPSTOCK ASSEMBLY

(71) Applicant: Halliburton Energy Services, Inc., Houston, TX (US)

(72) Inventor: William Wallace Dancer, Denton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/118,695

(22) PCT Filed: Feb. 6, 2013

(86) PCT No.: PCT/US2013/024828
§ 371 (c)(1),
(2) Date: Nov. 19, 2013

(87) PCT Pub. No.: WO2014/123517
PCT Pub. Date: Aug. 14, 2014

(65) Prior Publication Data
US 2014/0216760 A1 Aug. 7, 2014

(51) Int. Cl.
*E21B 17/07* (2006.01)
*E21B 7/06* (2006.01)
*E21B 23/00* (2006.01)
*E21B 47/024* (2006.01)

(52) U.S. Cl.
CPC ..... *E21B 7/061* (2013.01); *E21B 23/00* (2013.01); *E21B 47/024* (2013.01); *E21B 17/07* (2013.01)

(58) Field of Classification Search
CPC ..... E21B 7/061; E21B 23/01; E21B 17/07; E21B 17/02
USPC ..... 166/255.3, 177.6, 177.5, 242.7, 242.6, 166/255.2; 175/79–81; 285/2
See application file for complete search history.

(56) References Cited

U.S. PATENT DOCUMENTS 3,398,795 A * 8/1968 Elliston ..... 166/120
3,908,759 A * 9/1975 Cagle et al. ..... 166/117.6
4,064,953 A * 12/1977 Collins ..... 175/321
4,807,704 A 2/1989 Hsu et al.
5,564,503 A 10/1996 Longbottom et al.

(Continued)

FOREIGN PATENT DOCUMENTS

WO 2014123517 A1 8/2014

OTHER PUBLICATIONS

International Search Report and Written Opinion for PCT/US2013/024828 dated Oct. 17, 2013.

*Primary Examiner* — Shane Bomar
*Assistant Examiner* — Kipp Wallace
(74) *Attorney, Agent, or Firm* — McDermott Will & Emery LLP; Alan Bryson

(57) ABSTRACT

Disclosed are downhole subassembly systems and method of use thereof. One downhole subassembly system is an orientable whipstock subassembly that includes a whipstock apparatus including a deflector surface operable to direct a cutting tool into a casing sidewall to create a casing exit, and an orienting sub comprising an upper coupling operatively coupled to the whipstock apparatus and a lower coupling at least partially engaged with the upper coupling and rotationally movable with respect thereto while in an un-collapsed configuration and rotationally fixed with respect thereto while in a collapsed configuration.

20 Claims, 4 Drawing Sheets

(56) References Cited

U.S. PATENT DOCUMENTS

| | | | | |
|---|---|---|---|---|
| 5,871,046 | A | 2/1999 | Robison | |
| 6,012,527 | A | 1/2000 | Nitis et al. | |
| 6,070,667 | A | 6/2000 | Gano | |
| 6,073,691 | A | 6/2000 | White | |
| 6,378,609 | B1 * | 4/2002 | Oneal et al. | 166/278 |
| 6,382,323 | B1 | 5/2002 | Gano et al. | |
| 6,497,288 | B2 * | 12/2002 | George et al. | 166/377 |
| 8,511,392 | B2 * | 8/2013 | Howlett et al. | 166/381 |
| 2007/0181308 | A1 * | 8/2007 | Jelsma | 166/313 |
| 2010/0012322 | A1 | 1/2010 | McGarian | |
| 2012/0103687 | A1 | 5/2012 | Saurer | |

* cited by examiner

SYSTEMS AND METHODS FOR ROTATIONALLY ORIENTING A WHIPSTOCK ASSEMBLY

BACKGROUND

The present invention relates generally to downhole subassembly systems and, more particularly, to an orientable whipstock assembly used to orient a whipstock to a desired circumferential location.

Hydrocarbons can be produced through relatively complex wellbores traversing a subterranean formation. Some wellbores can include multilateral wellbores and/or sidetrack wellbores. Multilateral wellbores include one or more lateral wellbores extending from a parent (or main) wellbore. A sidetrack wellbore is a wellbore that is diverted from a first general direction to a second general direction. A sidetrack wellbore can include a main wellbore in a first general direction and a secondary wellbore diverted from the main wellbore in a second general direction. A multilateral wellbore can include one or more windows or casing exits to allow corresponding lateral wellbores to be formed. A sidetrack wellbore can also include a window or casing exit to allow the wellbore to be diverted to the second general direction.

The casing exit for either multilateral or sidetrack wellbores can be formed by positioning a casing joint and a whipstock in a casing string at a desired location in the main wellbore. The whipstock is used to deflect one or more mills laterally (or in an alternative orientation) relative to the casing string. The deflected mill(s) machines away and eventually penetrates part of the casing joint to form the casing exit in the casing string. Drill bits can be subsequently inserted through the casing exit in order to cut the lateral or secondary wellbore.

Lateral wellbores are usually drilled from the parent wellbore in a predetermined direction configured to maximize hydrocarbon recovery. In such installations, it is necessary to form the window at a predetermined circumferential orientation relative to the parent casing. In order to properly position and rotationally orient the whipstock such that the window is milled in the desired direction, a latch assembly associated with the whipstock is extended and anchored into a latch coupling installed or otherwise interconnected in the casing string. The latch assembly typically includes a plurality of spring operated keys, each of which have an anchoring and orienting profile that is received in a mating profile defined internally within the latch coupling. As a result, when the latch assembly is operatively engaged with the internal profile of the latch coupling, the latch assembly and the uphole equipment associated therewith may be anchored and rotationally oriented to the desired direction within the casing string.

A significant amount of well planning goes into properly orienting the latch assembly and whipstock before they are introduced into the wellbore. Nonetheless, it has been found in some cases that operative engagement of the latch assembly with the latch coupling sometimes fails to place the whipstock into correct alignment with the desired rotational orientation. In such cases, the whipstock is secured in the incorrect orientation and otherwise not able to rotate independently to correct the misalignment. Instead, in some cases, the whipstock must be returned to the surface and realigned for an additional trip into the wellbore. As can be appreciated, such corrective actions require a significant amount of time and expense, and it would be advantageous to forgo such remedial efforts.

SUMMARY OF THE DISCLOSURE

The present invention relates generally to downhole subassembly systems and, more particularly, to an orientable whipstock assembly used to orient a whipstock to a desired circumferential location.

In some embodiments, an orientable whipstock subassembly is disclosed. The assembly may include a whipstock apparatus including a deflector surface operable to direct a cutting tool into a casing sidewall to create a casing exit, and an orienting sub comprising an upper coupling operatively coupled to the whipstock apparatus and a lower coupling at least partially engaged with the upper coupling and rotationally movable with respect thereto while in an un-collapsed configuration and rotationally fixed with respect thereto while in a collapsed configuration.

In other embodiments, a method of rotationally orienting a whipstock apparatus in a wellbore may be disclosed. The method may include conveying the whipstock apparatus into the wellbore, the whipstock apparatus being operatively coupled to an orienting sub that includes an upper coupling and a lower coupling movable between an un-collapsed configuration and a collapsed configuration, landing the whipstock apparatus within the wellbore, rotationally orienting the whipstock apparatus with the orienting sub to a desired angular direction with respect to the wellbore, and moving the orienting sub into the collapsed configuration.

In yet other embodiments, an orienting sub may be disclosed and may include an upper coupling defining a first inner surface and a second inner surface and providing a first plurality of lugs on the second inner surface, and a lower coupling extendable within the upper coupling and defining an outer surface that provides a second plurality of lugs configured to mesh with the first plurality of lugs when the upper and lower couplings move from an un-collapsed configuration to a collapsed configuration.

The features of the present disclosure will be readily apparent to those skilled in the art upon a reading of the description of the preferred embodiments that follows.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present invention relates generally to downhole subassembly systems and, more particularly, to an orientable whipstock assembly used to orient a whipstock to a desired circumferential location.

The systems and methods disclosed herein provide an orienting sub that may be used to rotationally orient or otherwise align a whipstock or deflector tool such that a casing exit and corresponding lateral wellbore may be milled/drilled in a correct angular direction from a parent wellbore. Such an orienting sub may prove advantageous in the event the engagement between the latch assembly and the latch coupling corresponding to a whipstock assembly fails to properly orient the whipstock or deflector in the proper angular direction. The exemplary orienting sub, as described herein, eliminates the need to have the latch coupling oriented in the proper position in the casing string and also eliminates the need to have the whipstock properly orientated with respect to the latch assembly. Rather, the exemplary orienting sub may be configured and otherwise designed to rotationally orient the whipstock on the fly while at depth downhole after the whipstock has landed (i.e., after the latch assembly and latch coupling have successfully been engaged).

Those skilled in the art will readily appreciate the several advantages this may afford including, but not limited to, decreased installation and a cost savings for a multilateral installation. This also reduces the need to plan exactly where the latch couplings are to be oriented in the casing string once landed downhole. This may also prove advantageous if information changed to where the lateral wellbore should be made after the latch coupling and the casing joint have been permanently cemented into the wellbore.

Figure 1:
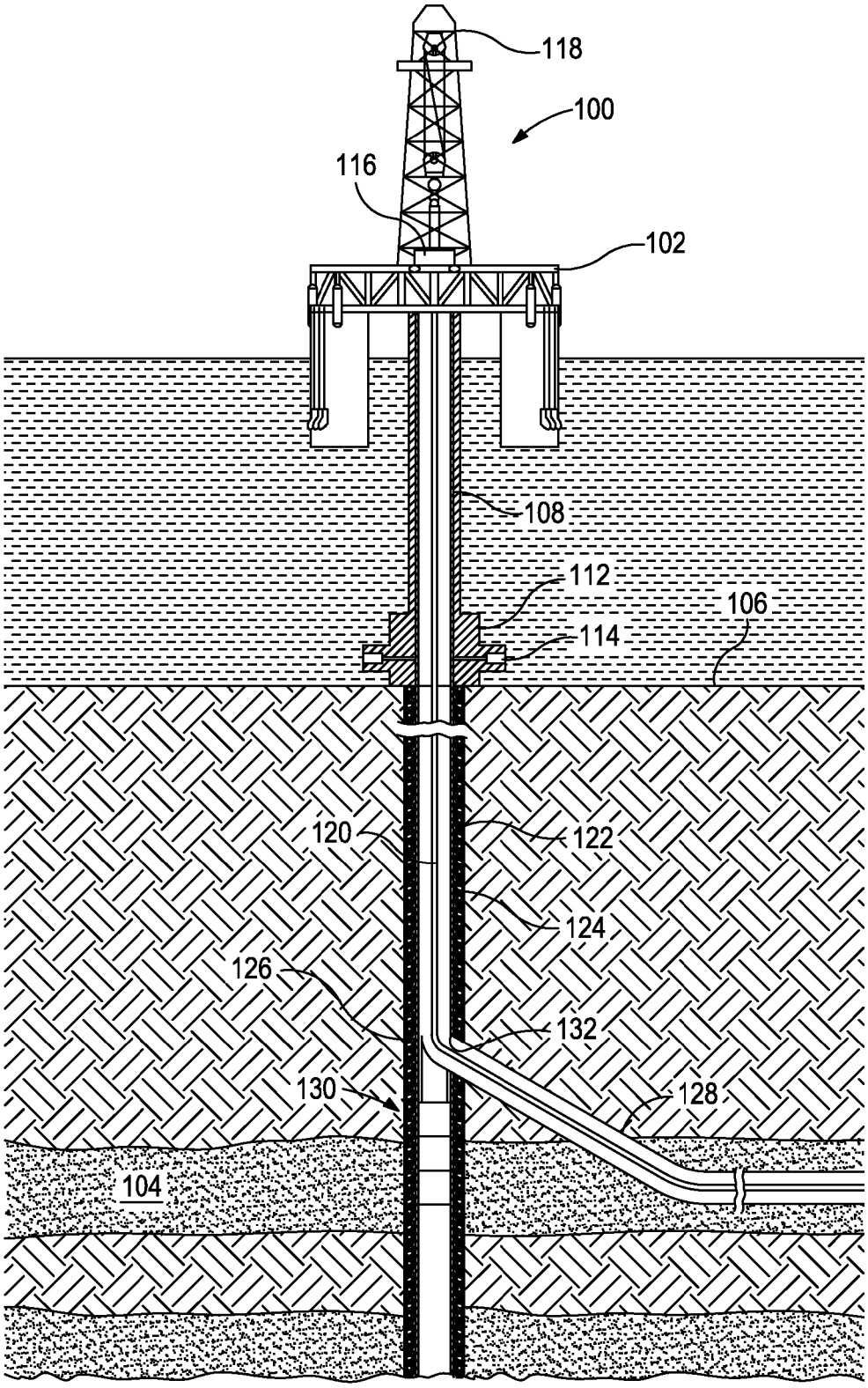
FIG. 1 is a schematic illustration of an offshore oil and gas platform using an exemplary orientable whipstock assembly, according to one or more embodiments disclosed.

Referring to FIG. 1, illustrated is an offshore oil and gas platform 100 that may employ an exemplary orientable whipstock subsubassembly 130, according to one or more embodiments. Even though FIG. 1 depicts an offshore oil and gas platform 100, it will be appreciated by those skilled in the art that the various embodiments of the orientable whipstock subsubassembly 130 disclosed herein are equally well suited for use in or on other types of oil and gas rigs, such as land-based oil and gas rigs or rigs located at any other geographical site.

The platform 100 may be a semi-submersible platform 102 centered over a submerged oil and gas formation 104 located below the sea floor 106. A subsea conduit 108 or riser extends from the deck of the platform 102 to a wellhead installation 112 that includes one or more blowout preventers 114. The platform 102 has a hoisting apparatus 116 and a derrick 118 for raising and lowering pipe strings or work strings, such as a drill string 120, within the subsea conduit 108.

As depicted, a main wellbore 122 has been drilled through the various earth strata, including the formation 104. The terms "parent" and "main" wellbore are used herein to designate a wellbore from which another wellbore is drilled. It is to be noted, however, that a parent or main wellbore does not necessarily extend directly to the earth's surface, but could instead be a branch of another wellbore. A casing string 124 is at least partially cemented within the main wellbore 122. The term "casing" is used herein to designate a tubular string used to line a wellbore. The casing may actually be of the type known to those skilled in the art as "liner" and may be segmented or continuous, such as coiled tubing.

A casing joint 126 may be interconnected between elongate portions or lengths of the casing string 124 and positioned at a desired location within the wellbore 122 where a branch or lateral wellbore 128 is to be drilled. The terms "branch" and "lateral" wellbore are used herein to designate a wellbore which is drilled outwardly from its intersection with another wellbore, such as a parent or main wellbore. Moreover, a branch or lateral wellbore may have another branch or lateral wellbore drilled outwardly therefrom.

The orientable whipstock subsubassembly 130 may be positioned within the casing string 124 and/or the casing joint 126 and, as will be described below, portions thereof may form an integral part of the casing string 124 and/or the casing joint 126. In typical operation, the orientable whipstock subsubassembly 130 may be configured to deflect one or more cutting tools (i.e., mills) into the inner wall of the casing joint 126 such that a casing exit 132 may be formed therein at a desired circumferential location. The casing exit 132 provides a "window" in the casing joint 126 through which one or more other cutting tools (i.e., drill bits) may be inserted in order to drill the lateral wellbore 128.

It will be appreciated by those skilled in the art that even though FIG. 1 depicts a vertical section of the main wellbore 122, the embodiments described in the present disclosure are equally applicable for use in wellbores having other directional configurations including horizontal wellbores, deviated wellbores, slanted wellbores, diagonal wellbores, combinations thereof, and the like. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
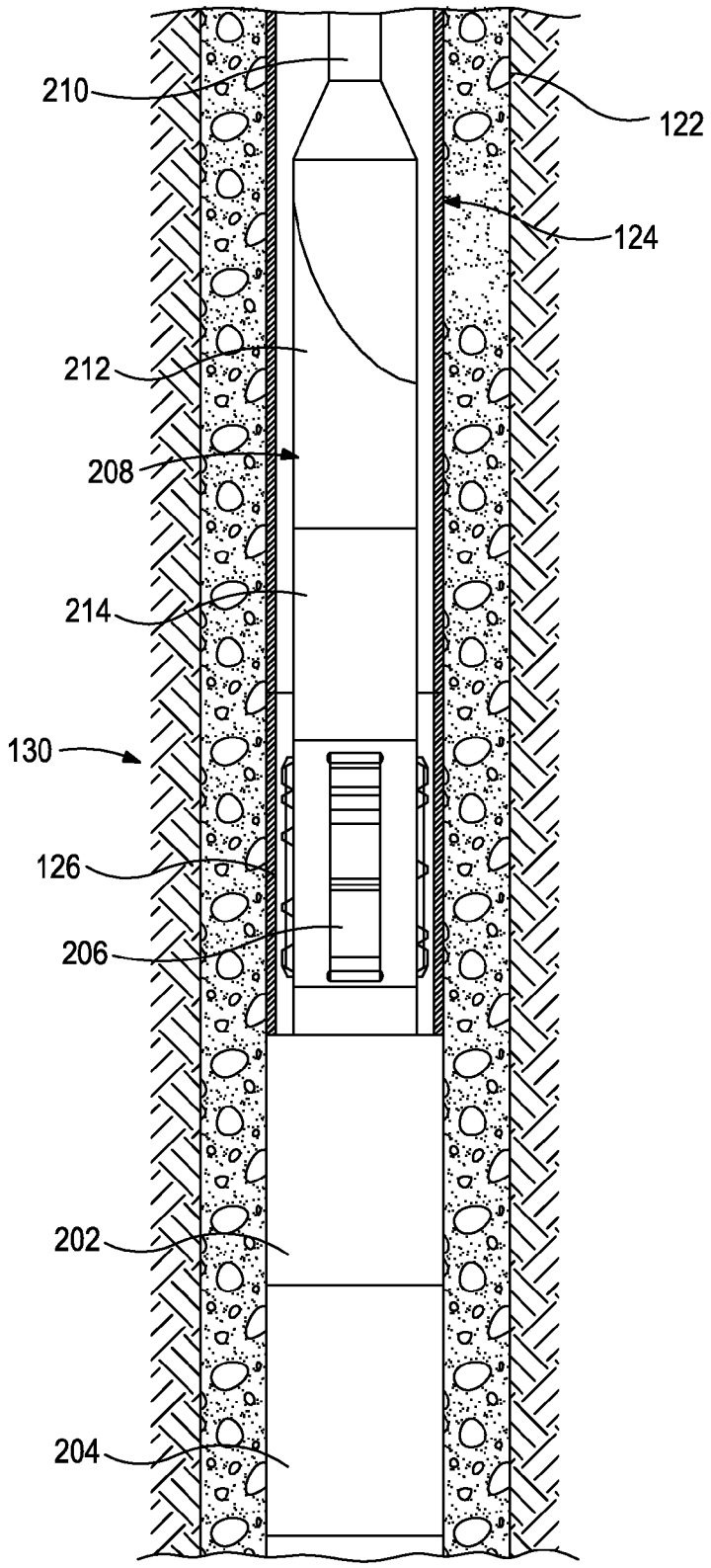
FIG. 2 is an enlarged view of the exemplary orientable whipstock assembly of FIG. 1, according to one or more embodiments.

Referring now to FIG. 2, with continued reference to FIG. 1, illustrated is an enlarged view of the exemplary orientable whipstock subsubassembly 130, according to one or more embodiments. The orientable whipstock subsubassembly 130 may include various tools and tubular lengths configured to be interconnected downhole such that a whipstock apparatus 208 will be properly oriented within the wellbore 122 in order to drill the lateral wellbore 128 (FIG. 1) in a predetermined direction. In some embodiments, for example, the orientable whipstock subsubassembly 130 may include a latch coupling 202 and one or more casing subs 204 coupled to or otherwise forming an integral part of the casing string 124. The latch coupling 202 may have a profile and a plurality of circumferential alignment elements operable to receive a latch assembly 206 therein and thereby locate the latch assembly 206 in a particular circumferential orientation.

As used herein, the term "latch coupling" refers to any type of anchoring device capable of being secured within the casing string 124 and otherwise configured to interact with the latch assembly 206. The latch coupling may include, for example, but is not limited to, a wellbore packer device, a wellbore bridge device, a wellbore plug device, any other type of wellbore isolation device, and the like. Accordingly, the latch assembly 206 may be configured to locate and couple to any of the above-referenced types of anchoring devices, without departing from the scope of the disclosure.

The casing sub 204 may include or otherwise encompass several downhole tools or subs known to those skilled in the art. For example, the casing sub 204 may include an alignment bushing having a longitudinal slot that is circumferentially referenced to the circumferential alignment elements of the latch coupling 202. The casing sub 204 may also include a casing alignment sub used to ensure proper alignment of the latch coupling 202 relative to the alignment bushing. It will be understood by those skilled in the art that the orientable whipstock subsubassembly 130 may include a greater or lesser number of tools or a different set of tools that are operable to enable a determination of an offset angle between a circumferential reference element and a desired circumferential orientation of the casing exit 132 (FIG. 1).

As illustrated, the casing string 124 includes the casing joint 126 that may be formed from or otherwise made of an easily minable or drillable material such as aluminum. In other embodiments, the casing joint 126 may be formed from or otherwise made of standard casing or could have a pre-milled window formed therein. In yet other embodiments, the casing joint 126 may be made of various composite materials such as, but not limited to, fiberglass, carbon fiber, combinations thereof, or the like. The use of composite materials for the casing joint 126 may prove advantageous since cuttings resulting from the milling of the casing exit 132 through the casing joint 126 will not produce magnetically-charged debris that could magnetically-bind with downhole metal components or otherwise be difficult to circulate out of the well. It should be noted that, even though the latch coupling 202 and the casing joint 126 are depicted as being interconnected within the casing string 124 proximate one another, those skilled in the art will recognize that other downhole tools or tubulars may alternatively be interconnected within the casing string 124 between the latch coupling 202 and the casing joint 126.

The whipstock apparatus 208 may run into the casing string 124 on a conveyance 210 such as jointed tubing, coiled tubing, or the like. In the illustrated embodiment, the whipstock apparatus 208 includes a deflector assembly 212 having a deflector surface operable to engage and direct a milling or drilling tool (not shown) into a casing sidewall, such as the sidewall of the casing joint 126, to create the casing exit 132 (FIG. 1) therethrough. The latch assembly 206 may be operatively coupled to or otherwise form an integral part of the whipstock apparatus 208. As used here, "operatively coupled" means that the latch assembly 206 may be directly or indirectly coupled to the whipstock apparatus 208. As illustrated, the latch assembly 206 may be arranged downhole from the whipstock apparatus 208.

In exemplary operation, the whipstock apparatus 208 is run into the casing string 124 until the latch assembly 206 engages the latch coupling 202 already cemented within the wellbore 122 in a desired orientation. The latch assembly 206 may have a unique outer profile that is operable to engage the corresponding unique inner profile and preferential circumferential alignment elements of the latch coupling 202. When the latch assembly 206 is properly coupled to the latch coupling 202, the whipstock apparatus 208 will be ideally arranged such that the deflector assembly 212 is axially and circumferentially oriented within the casing string 124 such that milling and drilling tools (not shown) are appropriately directed into the inner wall of the casing joint 126 for forming the casing exit 132 and subsequently drilling the lateral wellbore 128 (FIG. 1).

If, for some reason, however, the whipstock apparatus 208 is not properly aligned in the desired circumferential orientation within the casing string 124, an orienting sub 214 may be used to rotationally align or otherwise orient the whipstock apparatus 208 to the appropriate angular direction on the fly and while the whipstock apparatus 208 is at depth. As illustrated, the orienting sub 214 may be coupled to or otherwise form an integral part of the whipstock apparatus 208. In at least one embodiment, the orienting sub 214 may interpose the whipstock apparatus 208 and the latch assembly 206. As a result, the latch assembly 206 may be operatively coupled to the whipstock apparatus 208 via the orienting sub 214. In other embodiments, however, the orienting sub 214 may be arranged on the orientable whipstock subassembly 130 at any suitable location configured to circumferentially orient the whipstock apparatus 208.

Figure 3:
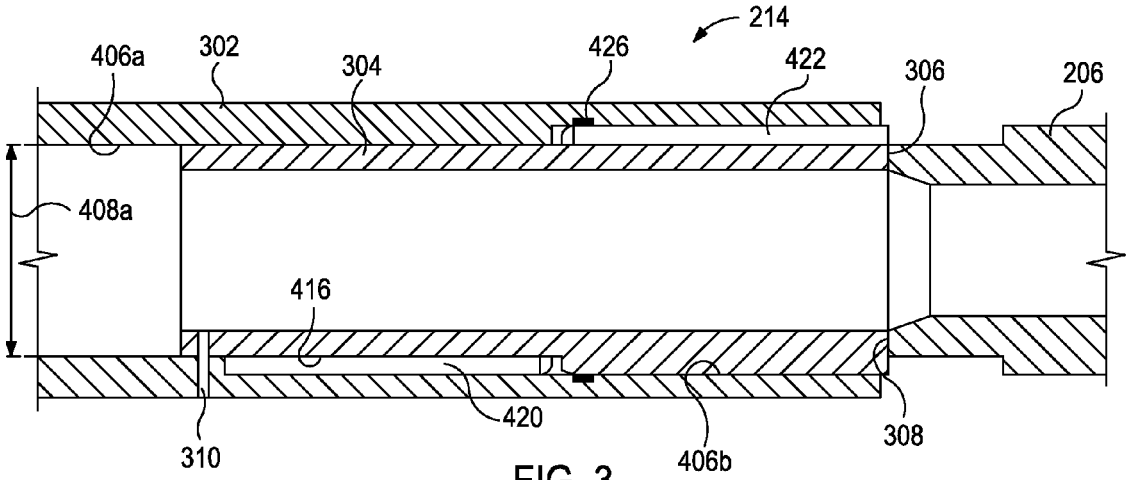
FIG. 3 illustrates a cross-sectional view of a portion of an exemplary orienting sub in an un-collapsed configuration, according to one or more embodiments.

Referring now to FIG. 3, with continued reference to FIG. 2, illustrated is a cross-sectional view of a portion of the orienting sub 214, according to one or more embodiments. As illustrated in FIG. 3, the orienting sub 214 may include at least an upper coupling 302 in engagement with a lower coupling 304. In some embodiments, the uphole end of the upper coupling 302 (i.e., to the left in FIG. 3) may be coupled or otherwise attached to the downhole end (not shown) of the whipstock apparatus 208 (FIG. 2). In at least one embodiment, the upper coupling 302 may be threaded to the downhole end of the whipstock apparatus 208, but may equally be mechanically fastened or welded to the whipstock apparatus 208, or combinations thereof, without departing from the scope of the disclosure.

In some embodiments, a downhole end 306 of the lower coupling may be coupled or otherwise attached to an uphole end 308 of the latch assembly 206. As with the upper coupling 302, the downhole end 306 of the lower coupling 304 may be threaded, mechanically fastened, or welded to the uphole end 308 of the latch assembly 206, or combinations thereof. It should be noted, however, that the upper and lower couplings 302, 304 may equally be coupled or attached to other known downhole components or tools, and nonetheless function to properly orient the whipstock apparatus 208, as generally described herein.

Figure 5:
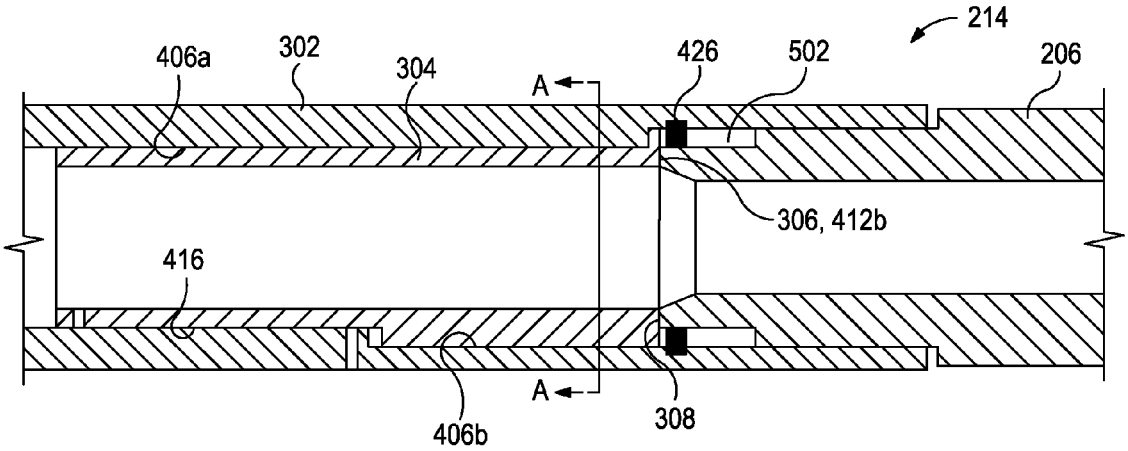
FIG. 5 illustrates a cross-sectional view of the exemplary orienting sub of FIG. 3 in a collapsed configuration, according to one or more embodiments.

The orienting sub 214 may be configured to move between an un-collapsed configuration, as depicted in FIG. 3, and a collapsed configuration, as depicted in FIG. 5. More specifically, FIG. 3 shows the upper and lower couplings 302, 304 in their un-collapsed configuration or "run-in" position where the lower coupling 304 is at least partially nested or otherwise extended within the upper coupling 302. During run-in, the upper and lower couplings 302, 304 may be coupled together using one or more shearable devices 310, such as shear pins, shear screws, shear rings, combinations thereof, or the like. The shearable devices 310 may extend at least partially into portions of each of the upper and lower couplings 302, 304. While only one shearable device 310 is depicted in FIG. 3, those skilled in the art will readily appreciate that any number of shearable devices 310 may be used to couple together the upper and lower couplings 302, 304.

The shearable devices 310 may be configured to secure the lower coupling 304 to the upper coupling 302 such that axial and rotational movement between the two couplings 302, 304 is substantially prevented while the whipstock apparatus 208 is being run into the wellbore 122 (FIG. 2) in the un-collapsed configuration. As a result, torque and/or axial loading may be transmitted between the upper and lower couplings 302, 304 via the shearable devices 310. As described in greater detail below, however, the shearable devices 310 may be configured to shear or otherwise fail upon being subjected to a predetermined axial or torsional loading, thereby allowing the upper and lower couplings to rotate freely with respect to one another once the shearable devices 310 are sheared.

Figure 4A:
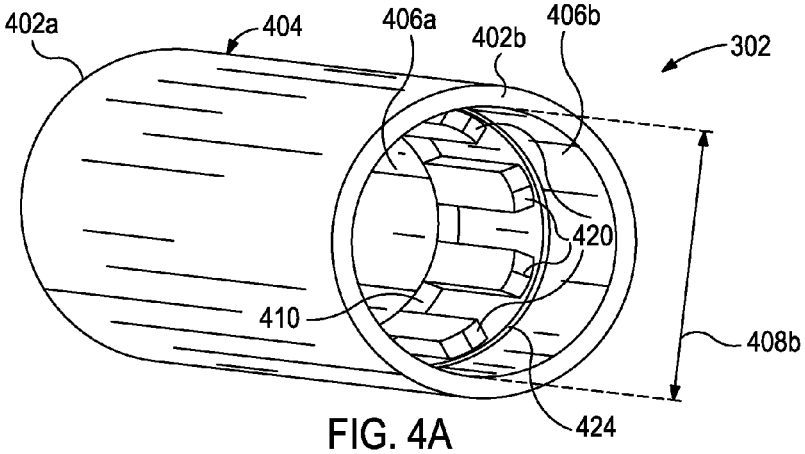
FIGS. 4A and 4B are isometric views of exemplary upper and lower couplings, respectively, according to one or more embodiments disclosed.
Figure 4B:
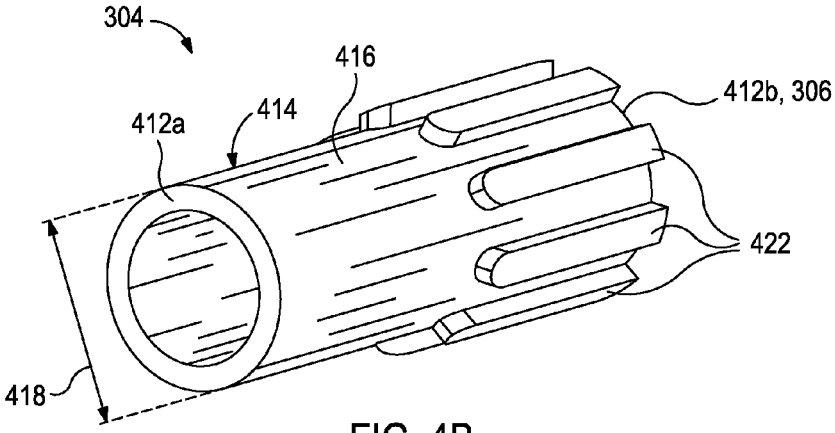

Referring to FIGS. 4A and 4B, with continued reference to FIG. 3, illustrated are isometric views of the upper and lower couplings 302, 304, respectively. As illustrated in FIG. 4A, the upper coupling 302 may be a generally cylindrical structure having a first end 402*a* and a second end 402*b* and an elongate body 404 that extends therebetween. The body 404 may define at least two inner surfaces that extend axially along corresponding portions of the interior of the body 404. Specifically, the body 404 may define a first inner surface 406*a* that exhibits a first inner diameter 408*a* (FIG. 3) and a second inner surface 406*b* that exhibits a second inner diameter 408*b*, where the first inner diameter 408*a* is less than the second inner diameter 408*b*. The first inner surface 406*a* may transition to the second inner surface 406*b* at an intermediate point along the interior of the body 404, such as at a shoulder 410 defined in or on the interior of the body 404.

As illustrated in FIG. 4B, the lower coupling 304 may also be a generally cylindrical structure having a first end 412*a* and a second end 412*b* and an elongate body 414 that extends therebetween. The second end 412*b* of the lower coupling 304 may generally correspond to the downhole end 306 discussed above with reference to FIG. 3. The body 414 may define an outer surface 416 that exhibits an outer diameter 418. The outer diameter 418 may be slightly smaller than the first inner diameter 408*a* of the upper coupling 302 such that when the upper and lower couplings 302, 304 are fully interconnected or otherwise in the collapsed configuration (FIG. 5), the outer surface 416 of the lower coupling 304 engages or at least comes into close contact with the first inner surface 406*a* of the upper coupling 302.

Referring again to FIG. 4A, the body 404 of the upper coupling 302 may provide a plurality of lugs 420 defined on the second inner surface 406*b* and extending axially from the shoulder 410. In some embodiments, the lugs 420 may be equidistantly spaced about the circumference of the second inner surface 406*b*. In other embodiments, however, the lugs 420 may be randomly spaced or otherwise strategically spaced from each other in a predetermined non-equidistant pattern, without departing from the scope of the disclosure. With reference to FIG. 4B, the body 414 of the lower coupling 304 may likewise provide a plurality of lugs 422 defined on its outer surface 416. Similar to the lugs 420 of the upper coupling 302, the lugs 422 of the lower coupling 304 may be equidistantly spaced about the circumference of the outer surface 416, but may equally be randomly spaced or otherwise strategically spaced from each other in a predetermined non-equidistant pattern, without departing from the scope of the disclosure.

When the orientable sub 214 is in the un-collapsed configuration, such as is depicted in FIG. 3, the lugs 420, 422 are generally disengaged from each other. Instead, in the un-collapsed configuration, the lugs 420 of the upper coupling 302 may engage or otherwise come into close contact with the outer surface 416 of the lower coupling 304, and the lugs 422 of the lower coupling 304 may engage or otherwise come into close contact with the second inner surface 406*b* of the upper coupling 302.

As described in greater detail below, the lugs 420 of the upper coupling 302 may be configured to mesh with or otherwise interleave the lugs 422 of the lower coupling 304 when the orienting sub 214 is in its collapsed configuration. To help facilitate this meshing relationship, the tips of some or all of the lugs 420, 422 may be rounded, as illustrated. In other embodiments, however, the tips of some or all of the lugs 420, 422 may be angled, chamfered, oblique, or otherwise formed such that, upon the orienting sub 214 being moved into the collapsed configuration, the lugs 420, 422 are able to correspondingly extend between each other to form the meshing relationship without binding on each other. To this end, the spacing of the lugs 420 of the upper coupling 302 may be strategically spaced to receive the lugs 422 of the lower coupling 304, whether equidistantly spaced or otherwise randomly spaced, as generally discussed above.

With reference to FIGS. 3 and 4A, the second inner surface 406*b* of the upper coupling 302 may further define an arcuate slot or groove 424 configured to receive a retaining ring 426 or the like therein. The groove 424 may be axially spaced from the lugs 420 in the direction of the second end 402*b* of the upper coupling 302, and the retaining ring 426 may be, for example, a snap ring or the like configured to radially contract once freed from biasing engagement with a radially adjacent component or structure. With the upper and lower couplings 302, 304 in the un-collapsed configuration, such as is depicted in FIG. 3, the retaining ring 426 biases the lugs 422 of the lower coupling 304.

Referring again to FIG. 2, with continued reference to FIGS. 3 and 4A-4B, exemplary operation of the orienting sub 214 is now provided. Once the latch assembly 206 is properly landed or otherwise engaged with the latch coupling 202, as generally described above, the shearable devices 310 may be sheared by subjecting the shearable devices 310 to axial and/or torsional loading. In some embodiments, the axial and/or torsional loading may be applied from the surface via the conveyance 210 and the whipstock apparatus 208. For example, weight or rotational force may be applied to the upper coupling 302 via engagement with the whipstock apparatus 208 and the conveyance 210. In other embodiments, however, the axial and/or torsional loading may be applied to the shearable devices 310 via one or more localized downhole tools or devices such as, but not limited to, an electro-mechanical actuator, a hydraulic actuator, a piston/cylinder assembly, a downhole motor, an impact hammer, combinations thereof, and the like. In any event, the shearable devices 310 may be subjected to a predetermined amount of axial and/or torsional loading configured to shear or otherwise break the shearable devices 310.

Once the shearable devices 310 are sheared, the upper and lower couplings 302, 304 may be able to rotate freely with respect to one another, with the lower coupling 304 still being arranged at least partially within the upper coupling 302. At this point, the whipstock apparatus 208 and the deflector assembly 212, as coupled to the upper coupling 302, may be indexed or otherwise rotated to the orientation required to accurately form the casing exit 132 (FIG. 1). In some embodiments, the whipstock apparatus 208 and deflector assembly 212 may be indexed using, for example, a running tool (not shown), such as a hydraulic running tool, or any other known downhole tool installed in the orientable whipstock subassembly 130 and operable to assist with the running or landing of the whipstock apparatus 208 at depth.

One or more sensor subs (not shown), such as a measure-while-drilling sub, may communicate with the running tool or similar device in order to accurately orient the whipstock apparatus 208 based on downhole measurements. In operation, for example, the sensor sub(s) may be configured to provide the running tool or similar device with real-time inclination and azimuth readings for the whipstock apparatus 208. Such readings or measurements will help determine which direction the whipstock apparatus 208 must be rotated and will verify when the proper orientation is ultimately achieved. Those skilled in the art will readily appreciate that any device capable of confirming the proper orientation of the whipstock apparatus 208 downhole may be used.

Once proper orientation of the whipstock apparatus 208 is achieved, the orienting sub 214 may be moved from its un-collapsed configuration, as shown in FIG. 3, to the collapsed configuration, as shown in FIG. 5. The collapsed configuration may be achieved by generally pushing the upper and lower couplings 302, 304 together such that the lugs 420, 422 become engaged and form a meshing relationship or otherwise become interleaved. In some embodiments, the upper and lower couplings 302, 304 may be pushed together by applying an axial load from the surface. In other embodiments, however, the upper and lower couplings 302, 304 may be pushed together using one or more downhole devices such as, but not limited to, an electro-mechanical actuator, a hydraulic actuator, a piston/cylinder assembly, a downhole motor, combinations thereof, and the like, without departing from the scope of the disclosure.

Referring now to FIG. 5, with continued reference to FIGS. 3 and 4A-4B, illustrated is the orienting sub 214 in its collapsed configuration, according to one or more embodiments. In particular, FIG. 5 illustrates the orienting sub 214 after the upper and lower couplings 302, 304 have been pushed together, as generally described above, thereby intermeshing the lugs 420 of the upper coupling 302 with the lugs 422 of the lower coupling 304. Upon moving the orienting sub 214 to the collapsed configuration, the retaining ring 426 may be able to slide out of biasing engagement with the lugs 422 of the lower coupling 304. Once free from the lugs 422 of the lower coupling 304, the retaining ring 426 may be configured to radially contract and locate, for example, a recess 502 defined in the outer surface of the latch assembly 206. Upon radially contracting, the retaining ring 426 may be configured to trap the lower coupling 304 within the upper coupling 302, and otherwise prevent the lower coupling 304 from exiting the upper coupling 302. As will be appreciated, the recess 502 could equally be defined on a portion of the orienting sub 214, without departing from the scope of the disclosure.

Figure 6:
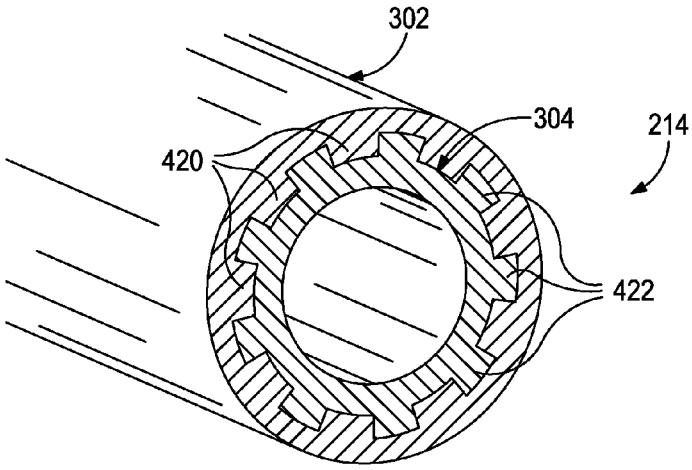
FIG. 6 illustrates an isometric cut-away end view of the orienting sub as taken along the lines A-A of FIG. 5.

FIG. 6 illustrates an isometric cut-away end view of the orienting sub 214 in the collapsed configuration as taken along lines A-A in FIG. 5. As illustrated, the lugs 420 of the upper coupling 302 are interleaved with the lugs 422 of the lower coupling 304, thereby preventing rotational movement of the upper and lower couplings 302, 304 with respect to one another. With the lugs 420, 422 engaged or otherwise interleaved, the casing exit 132 can then be milled in the proper angular direction and the lateral wellbore 128 can subsequently be drilled, as representatively illustrated in FIG. 1.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. An orientable whipstock subassembly, comprising:

a whipstock apparatus including a deflector surface operable to direct a cutting tool into a casing sidewall to create a casing exit; and an orienting sub comprising an upper coupling operatively coupled to the whipstock apparatus and a lower coupling at least partially engaged with the upper coupling and rotationally movable with respect thereto while in an un-collapsed configuration in a wellbore and rotationally fixed with respect thereto while in a collapsed configuration, wherein the upper coupling provides a first plurality of lugs on an inner surface and the lower coupling is at least partially extended within the upper coupling and provides a second plurality of lugs on an outer surface.

2. The subassembly of claim 1, further comprising:

a latch coupling fixed within a casing string; and a latch assembly operatively coupled to the whipstock apparatus and configured to engage the latch coupling to secure the whipstock apparatus within the casing string.

3. The subassembly of claim 2, wherein the orienting sub interposes the whipstock apparatus and the latch assembly.

4. The subassembly of claim 2, wherein the orienting sub is able to rotationally orient the deflector surface to a desired angular direction with respect to the casing sidewall after the whipstock apparatus is secured within the casing string.

5. The subassembly of claim 1, wherein, when in the un-collapsed configuration, the first and second plurality of lugs are disengaged with each other, and wherein, when in the collapsed configuration, the first and second plurality of lugs are engaged and mesh with each other.

6. The subassembly of claim 1, wherein the upper and lower couplings are maintained in the un-collapsed configuration with one or more shearable devices extending at least partially into each of the upper and lower couplings, the one or more shearable devices being configured to prevent axial and/or rotational movement between the upper and lower couplings.

7. The subassembly of claim 6, wherein the one or more shearable devices are configured to fail upon being subjected to a predetermined axial and/or torsional loading, thereby allowing the upper and lower couplings to rotate freely with respect to one another and move to the collapsed configuration.

8. The subassembly of claim 1, further comprising a retaining ring arranged within a groove defined on the inner surface of the upper coupling, wherein, when the upper and lower couplings are moved to the collapsed configuration, the retaining ring prevents the lower coupling from exiting the upper coupling.

9. A method of rotationally orienting a whipstock apparatus in a wellbore, comprising:

conveying the whipstock apparatus into the wellbore, the whipstock apparatus being operatively coupled to an orienting sub that includes an upper coupling and a lower coupling movable between an un-collapsed configuration and a collapsed configuration, wherein the upper coupling provides a first plurality of lugs on an inner surface and the lower coupling is at least partially extended within the upper coupling and provides a second plurality of lugs on an outer surface;

landing the whipstock apparatus within the wellbore;

rotationally orienting the whipstock apparatus with the orienting sub to a desired angular direction with respect to the wellbore; and moving the orienting sub into the collapsed configuration by pushing the upper and lower couplings together such that the first and second plurality of lugs become interleaved.

10. The method of claim 9, wherein landing the whipstock apparatus within the wellbore comprises:

engaging a latch assembly operatively coupled to the whipstock apparatus with a latch coupling fixed within the wellbore; and securing the latch assembly to the latch coupling.

11. The method of claim 10, wherein rotationally orienting the whipstock apparatus follows securing the latch assembly to the latch coupling.

12. The method of claim 9, wherein conveying the whipstock apparatus into the wellbore comprises:

conveying the orienting sub into the wellbore in the un-collapsed configuration, the upper and lower couplings being maintained in the un-collapsed configuration with one or more shearable devices; and preventing axial and/or rotational movement between the upper and lower couplings with the one or more shearable devices as the orienting sub is conveyed into the wellbore.

13. The method of claim 12, wherein rotationally orienting the whipstock apparatus comprises:

shearing the one or more shearable devices; and indexing the whipstock apparatus to the desired angular rotation.

14. The method of claim 9, further comprising preventing the lower coupling from exiting the upper coupling with a retaining ring arranged within a groove defined on the inner surface of the upper coupling.

15. An orienting sub, comprising:

an upper coupling defining a first inner surface and a second inner surface and providing a first plurality of lugs on the second inner surface; and a lower coupling extendable within the upper coupling and defining an outer surface that provides a second plurality of lugs configured to mesh with the first plurality of lugs when the upper and lower couplings move from an un-collapsed configuration to a collapsed configuration in a wellbore, the first and second plurality of lugs being fully disengaged from each other while in the un-collapsed configuration, wherein the upper coupling is coupled to a whipstock apparatus and the lower coupling is coupled to a latch assembly.

16. The orienting sub of claim 15, wherein the upper and lower couplings are maintained in the un-collapsed configuration with one or more shearable devices extending at least partially into each of the upper and lower couplings, the one or more shearable devices being configured to substantially prevent axial and/or rotational movement between the upper and lower couplings.

17. The orienting sub of claim 16, wherein the one or more shearable devices are configured to fail upon being subjected to a predetermined axial and/or torsional loading, thereby allowing the upper and lower couplings to rotate freely with respect to one another and move to the collapsed configuration.

18. The orienting sub of claim 15, further comprising a retaining ring arranged within a groove defined on the second inner surface, wherein, when the upper and lower couplings are moved to the collapsed configuration, the retaining ring prevents the lower coupling from exiting the upper coupling.

19. The orienting sub of claim 15, wherein the first inner surface exhibits a first inner diameter and the second inner surface exhibits a second inner diameter that is greater than the first inner diameter.

20. The orienting sub of claim 15, wherein the latch assembly is configured to locate and couple to an anchoring device arranged within a wellbore.

* * * * *